US007432693B2

(12) United States Patent
Enjalbert

(10) Patent No.: US 7,432,693 B2
(45) Date of Patent: Oct. 7, 2008

(54) LOW DROP-OUT DC VOLTAGE REGULATOR

(75) Inventor: Jerome Enjalbert, Fonsorbes (FR)

(73) Assignee: Freescale Semiconductor, Inc., Austin, TX (US)

( * ) Notice: Subject to any disclaimer, the term of this patent is extended or adjusted under 35 U.S.C. 154(b) by 239 days.

(21) Appl. No.: 10/598,955

(22) PCT Filed: Mar. 15, 2005

(86) PCT No.: PCT/EP2005/002819

§ 371 (c)(1),
(2), (4) Date: Sep. 15, 2006

(87) PCT Pub. No.: WO2005/091100

PCT Pub. Date: Sep. 29, 2005

(65) Prior Publication Data

US 2007/0182399 A1 Aug. 9, 2007

(30) Foreign Application Priority Data

Mar. 15, 2004 (EP) ..... 04290820

(51) Int. Cl.
*G05F 1/40* (2006.01)
*G05F 1/56* (2006.01)

(52) U.S. Cl. ..... 323/280; 323/281

(58) Field of Classification Search ..... 323/268, 323/271, 273, 275, 280, 281, 315, 316
See application file for complete search history.

(56) References Cited

U.S. PATENT DOCUMENTS 5,867,015 A * 2/1999 Corsi et al. ..... 323/316
6,465,994 B1 10/2002 Xi
6,541,946 B1 * 4/2003 Chen et al. ..... 323/280
6,765,374 B1 * 7/2004 Yang et al. ..... 323/280
6,977,490 B1 * 12/2005 Zhang et al. ..... 323/280
7,218,087 B2 * 5/2007 Lin ..... 323/315
2002/0158612 A1 10/2002 Genest et al.
2003/0102851 A1 6/2003 Stanescu et al.

FOREIGN PATENT DOCUMENTS

EP 1336912 A1 8/2003

* cited by examiner

*Primary Examiner*—Matthew V Nguyen

(57) ABSTRACT

A low drop-out DC voltage regulator for regulating a voltage from a DC power supply applied to a load at an output of the regulator and comprising a pass device for controlling flow of current from the power supply to the load so as to control the output voltage at the regulator output, and a feedback loop for controlling the pass device. The feedback loop comprises a resistive feedback path and a capacitive feedback path that includes a feedback capacitive element in series, and comparator means responsive to signals from the feedback paths for applying to the pass device an error signal that is a function of the value of the output voltage relative to a nominal value so as to control the output voltage. The comparator means comprises feedback current producing means for maintaining a common point of the resistive feedback path and the capacitive feedback path at a reference voltage so as to produce a feedback current flowing in the resistive feedback path and in the capacitive feedback path in parallel between the regulator output and the common point, and current comparison means responsive to relative values of the feedback current and of a reference current for producing the error signal.

12 Claims, 4 Drawing Sheets

-PRIOR ART-

-PRIOR ART-

-PRIOR ART-

-PRIOR ART-

LOW DROP-OUT DC VOLTAGE REGULATOR

FIELD OF THE INVENTION

This invention relates to a DC voltage regulator and particularly to a low drop-out (LDO) voltage regulator.

BACKGROUND OF THE INVENTION

A DC voltage regulator provides to a load a well-specified and stable DC ('direct current') output voltage whose fluctuations from a nominal value are low compared to fluctuations of the power supply that is regulated. The operation of the regulator is based on feeding back an error signal whose value is a function of the difference between the actual output voltage and the nominal value, which is amplified and used to control current flow through a pass device (such as a power transistor) from the power supply to the load. The drop-out voltage is the value of the difference between the power supply voltage and the desired regulated voltage below which regulation is lost. A low drop-out voltage regulator continues to regulate the output voltage effectively until the power supply voltage reduces to a value close to the desired regulated value. A low drop-out voltage regulator is therefore particularly useful in applications where it is powered by the same power supply used to supply the load, since it continues to function almost until the power supply becomes too low to supply the load at the desired voltage in any case.

The low drop-out nature of the regulator makes it appropriate (over other types of regulators such as dc-dc converters and switching regulators) for use in many applications such as automotive, portable, and industrial applications with an internal power supply, especially a battery. In the automotive industry, the low drop-out voltage is necessary during cold-crank conditions where an automobile's battery voltage of nominally 12V can drop below 6V, for example. Demand for LDO voltage regulators is also apparent in hand held battery operated products (such as cellular phones, pagers, camera recorders and laptop computers).

A known LDO voltage regulator comprises a comparator, which is a differential voltage amplifier that produces the feedback error signal by comparing a voltage related to the output voltage to a reference voltage, an intermediate buffer stage responsive to the differential amplifier output, the pass device, and a bypass capacitor coupled to the load. These elements constitute a regulation loop which provides voltage regulation.

In many known LDO voltage regulators, the bypass capacitor has to have a large capacitance to ensure stability of the operation of the regulator, which is costly, especially since this usually requires the use of an external capacitor. Not only is the cost of the capacitor component itself higher if the component is larger but also the component occupies more space on the circuit board of the regulator. These factors are aggravated if a given device needs several voltage regulators. Moreover, design of the regulator is often complex, and the design complexity increases with the number of different poles in the regulator and with the effects of parasitic impedances and manufacturing tolerances.

There is a need for an LDO voltage regulator that alleviates some or all of the above disadvantages.

SUMMARY OF THE INVENTION

The present invention provides a low drop-out voltage regulator as described in the accompanying claims.

DETAILED DESCRIPTION OF THE PREFERRED EMBODIMENTS

Figure 1:
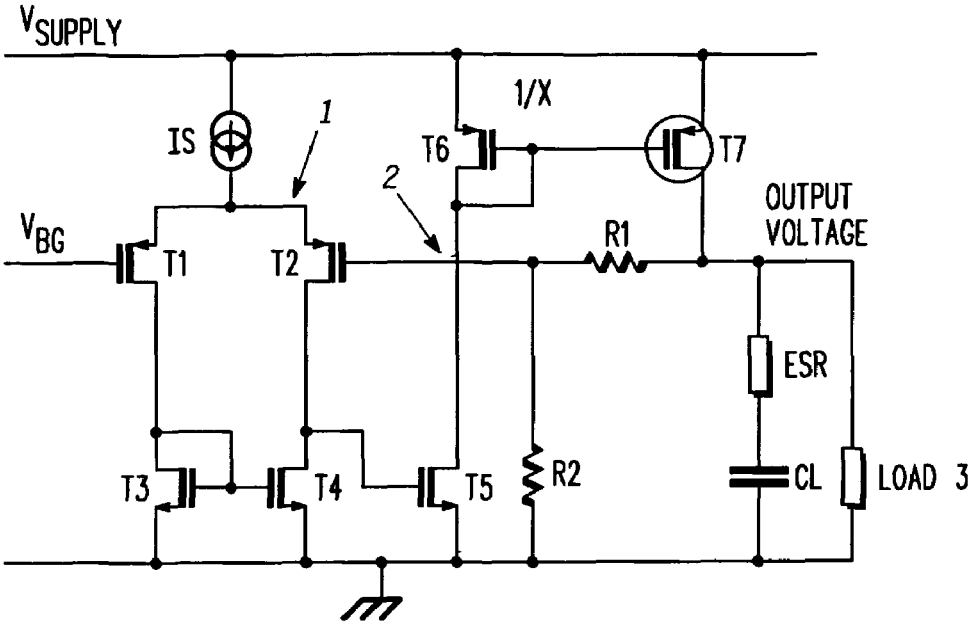
FIG. 1 is a schematic circuit diagram of a known LDO voltage regulator.

FIG. 1 shows a known LDO voltage regulator that comprises a differential voltage amplifier 1 including a PMOS transistor pair T1, T2 whose source-drain paths are connected in series with a constant current source IS and with respective NMOS transistors T3 and T4 whose gates are connected to the connection between the drains of transistors T1 and T3, the output of the amplifier 1 being taken from the connection between the drains of transistors T2 and T4. The regulator of FIG. 1 also includes an intermediate buffer stage 2 including transistors T5, T6 whose source-drain paths are connected in series across the power supply VSupply, and a pass device T7 which is a PMOS power transistor whose source-drain path is connected between the power supply VSupply and the load, the gates of transistors T6 and T7 being connected to the connection between the drains of transistors T5 and T6. A large external bypass capacitor CL having an equivalent series resistance ESR is connected in parallel with the load.

The differential amplifier 1 receives a BandGap reference voltage Vbg, on one differential input and on the other differential input receives a voltage proportional to the output voltage of the regulator from a voltage divider comprising two resistors R1 and R2 connected in series across the regulator output. The output voltage of the differential amplifier 1 at the connection between the PMOS transistor T2 and the NMOS transistor T4 is applied to the gate of the NMOS transistor T5 and the transistors T5, T6 then apply-this voltage to the gate of the pass device T7. These elements constitute a regulation loop which provides low drop-out DC voltage regulation of the output voltage applied to. the external bypass/load capacitor CL. The regulator is supplied with a supply voltage VSupply, for example from a battery, through a current source IS. The battery also supplies power to the load through the pass device T7 of the regulator.

Figure 2:
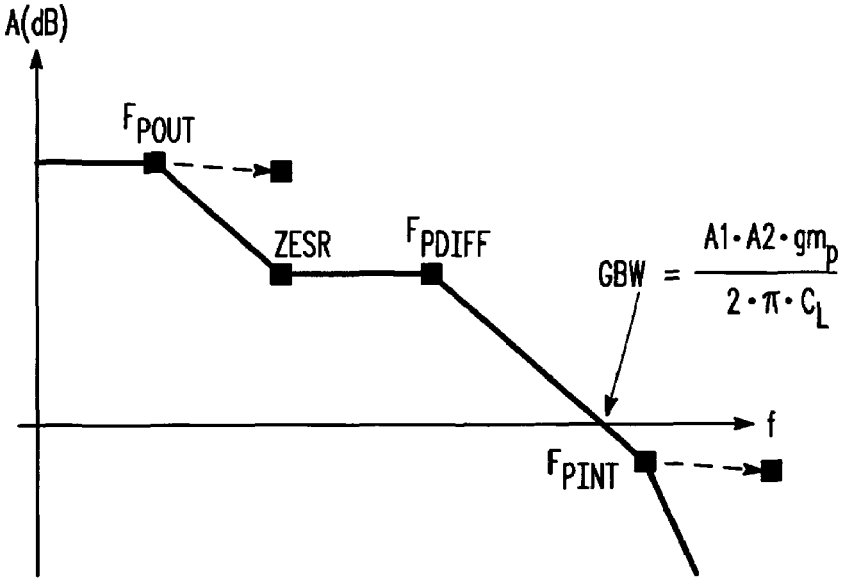
FIG. 2 is a modelised graph of the gain of the feedback loop of the regulator of FIG. 1 as a function of frequency.

FIG. 2 shows a modelised graph of the gain A of the voltage regulation loop against frequency f. Fpout is a dominant pole created by the bypass capacitor CL and depends on the values of CL and the impedance presented by the load (represented here as a resistance RL), Zesr is a 'zero' created by the equivalent series resistance ESR of the output capacitor CL and depends on the values of CL and ESR, Fpdiff is a further sub-dominant pole created by the differential amplifier 1 and Fpint is a further sub-dominant pole created by the intermediate stage 2, depending on the value of RL and the size of the pass device T7. It will be appreciated that the use of device T6 in the intermediate stage 2 in addition to the device T5 allows pole tracking of the poles Fpout and Fpin as shown by the arrowed dashed lines in FIG. 2 in response to changes in the current in the load.

The gain bandwidth GBW of the regulator is given by:

$$GBW = \frac{A_1 \cdot A_2 \cdot gm_p}{2 \cdot \pi \cdot C_L} \quad \text{Equation 1}$$

where $A_1$ is the gain of the differential amplifier 1, $A_2$ is the gain of the intermediate buffer 2, and $gm_p$ is the transconductance of the pass device T7.

It is found that, to ensure stability, the loop gain must be below 0 dB when the pole Fpint becomes influential and that the ESR 'zero' Zesr must be situated close to the pole Fpdiff. Both of these requirements necessitate a large value for the capacitance CL and, in a practical example of this regulator, the value of the capacitance CL is at least 10 μF per 100 mA of output current.

Figure 3:
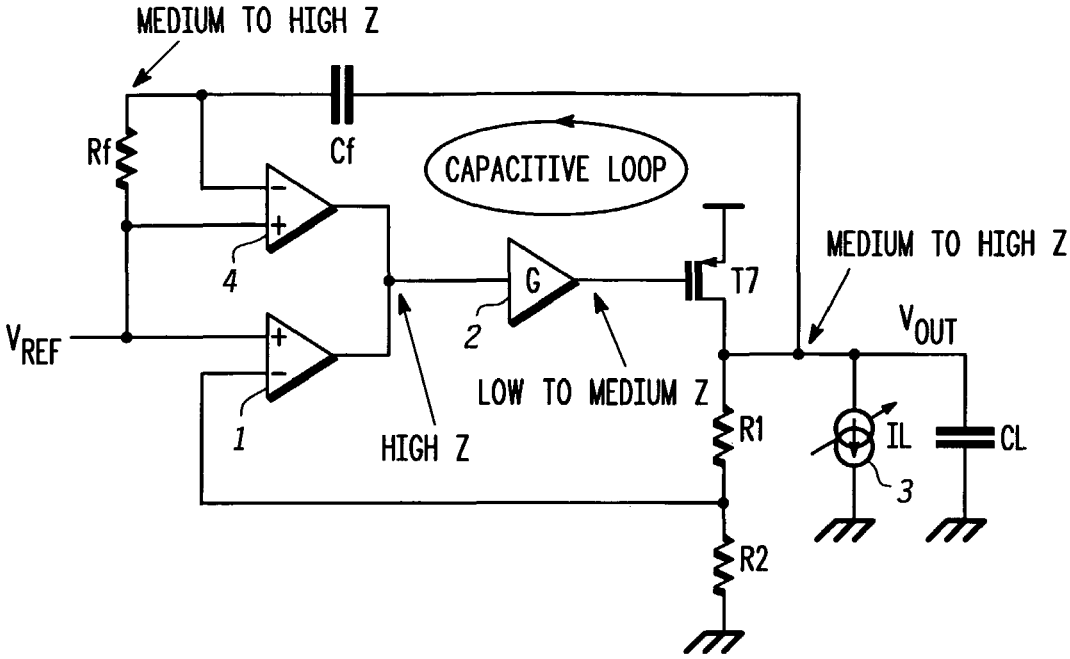
FIG. 3 is a schematic circuit diagram of another known LDO voltage regulator.

Some reduction in the bypass capacitance CL is obtained by the known regulator shown in FIG. 3. This regulator comprises a DC voltage feedback loop similar to the feedback loop in the regulator of FIG. 1 and comprising the resistors R1 and R2, a differential amplifier 1 similar to the differential amplifier 1 of FIG. 1 and a buffer 2 similar to the buffer 2 of FIG. 1. The load 3 is represented in FIG. 3 as a current source, illustrating the more general case where the load presents more than passive impedance.

In addition, the regulator of FIG. 3 comprises an AC feedback loop including in series a capacitor Cf and a resistor Rf connected to the source of the DC voltage reference Vref, and a further voltage differential amplifier 4, similar to the differential amplifier 1 of FIG. 1, whose input is responsive to the voltage across the resistor Rf, and hence to the current flowing in the resistor Rf, and whose output is also connected to the input of the buffer 2.

Figure 4:
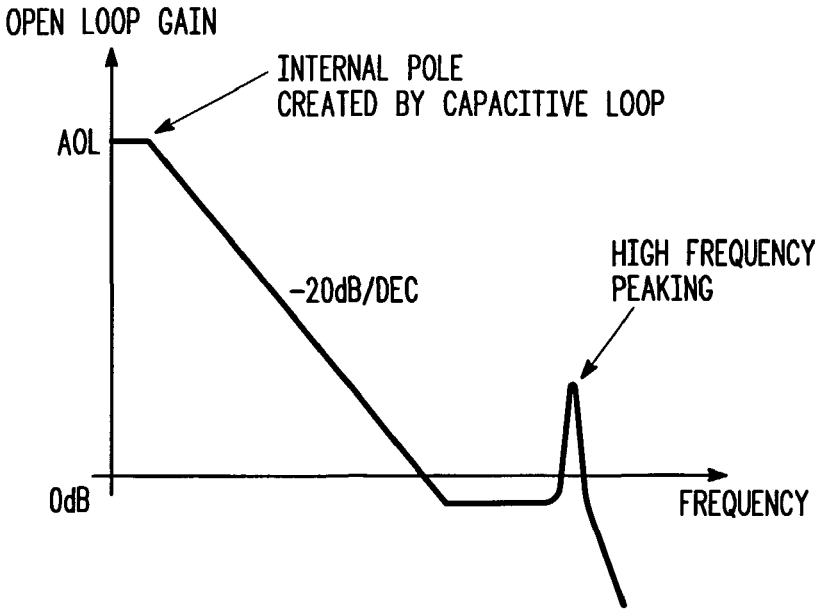
FIG. 4 is a modelised graph of the gain of the feedback loop of the regulator of FIG. 3 as a function of frequency.

It is found that the AC feedback loop with the bypass capacitance Cf creates a very low frequency dominant pole in the DC feedback loop, so that the regulator is stable with smaller values of the bypass capacitor CL than in the regulator of FIG. 1. However, it is also found that, when the bypass capacitor CL is further reduced, the output pole comes closer to the input poles and, since there are too many poles in the capacitive feedback loop with this configuration, the result is that the capacitive feedback loop becomes unstable. This appears in the overall loop response as a peak in the gain at a high frequency, as shown in FIG. 4. In a practical example of this regulator, the value of the capacitance CL still needs therefore to be at least 1 μF per 100 mA of output current.

Figure 5:
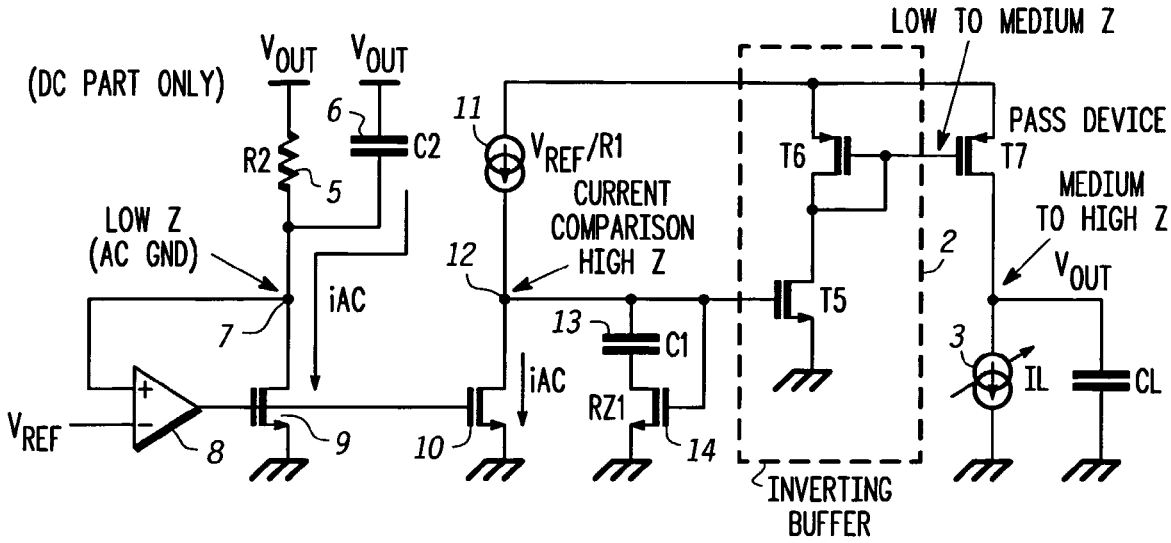
FIG. 5 is a schematic circuit diagram of an LDO voltage regulator in accordance with one embodiment of the invention, given by way of example.

FIG. 5 shows an example of a low drop-out DC voltage regulator in accordance with one embodiment of the present invention. This regulator includes a pass device T7 controlled by an inverting buffer 2, like the regulators of FIGS. 1 and 3. However the output voltage Vout from the regulator output is sensed through a resistive feedback path 5 and a capacitive feedback path 6 in parallel at a common point 7. A differential voltage amplifier 8 amplifies any difference in voltage between the common point 7 and a reference voltage Vref. This difference is applied to the gate of a first NMOS transistor 9 of a current mirror pair that also includes a second NMOS transistor 10. The source-drain conductive path of the first NMOS transistor 9 is connected between the common point 7 and ground and its gate is supplied by the output of the differential amplifier 8. The output voltage of the amplifier 8 is also applied to the gate of the second NMOS transistor 10, whose source-drain conductive path is connected in series with a source 11 of a constant current equal to Vref/R1 between the power supply Vsupply and ground. The connection 12 between the second NMOS transistor 10 and the constant current source 11 is connected to the gate of the NMOS transistor T5 as input to the inverting buffer 2.

In operation, the first NMOS transistor 9 conducts the feedback current flowing in the parallel feedback paths of resistor 5 and capacitor 6 and maintains the voltage of the common point 7 substantially equal to the reference voltage Vref, due to the amplification of any voltage difference by the amplifier 8 applied to the gate of the first NMOS transistor 9. The same output voltage of the amplifier 8 applied to the gate of the second NMOS transistor 10 causes the second NMOS transistor 10 to conduct the same current. Any difference between the current (Vout−Vref)/R2 flowing in the second NMOS transistor 10, mirrored from the first NMOS transistor 9, and the current Vref/R1 from the current source 11 constitutes an error signal applied to the buffer 2. The connection 12 presents a high impedance, so that the error signal appears as an-error voltage.

The buffer 2 responds to the error signal at the connection 12 corresponding to any difference between the current (Vout−Vref)/R2 flowing in the second NMOS transistor 10, mirrored from the first NMOS transistor 9, and the current Vref/R1 from the current source 11. The feedback loop acts to modify the regulator output voltage Vout until the error signal is zero, when $$\frac{Vout - Vref}{R2} = \frac{Vref}{R1} \Rightarrow Vout = Vref \cdot \left(1 + \frac{R2}{R1}\right) \quad \text{Equation 2}$$

The presence of the capacitive feedback path including the capacitor 6 forms a very low frequency, dominant pole in the feedback loop. The capacitive path is embedded in the current feedback structure so it has a larger bandwidth and one less pole than a capacitive loop in a voltage feedback structure. This improves the stability of the capacitive path and removes the peaking in the response of the feedback loop that is encountered with the regulator of FIG. 3.

A small capacitor 13 in series with the conductive path of an NMOS transistor 14 are connected in parallel with the conductive path of the second transistor 10 between the connection point 12 and ground. The gate of the transistor 14 is connected to the connection point 12, so that the transistor 14 acts to present a low resistance that varies as a function of the voltage applied to the gates of the transistors Rz1 and T5, which varies as a function of the output current drawn by the load. The capacitor 13 and transistor 14 reduce the feedback loop gain at high frequencies, where poles due to parasitic capacitances are likely to appear.

Figure 6:
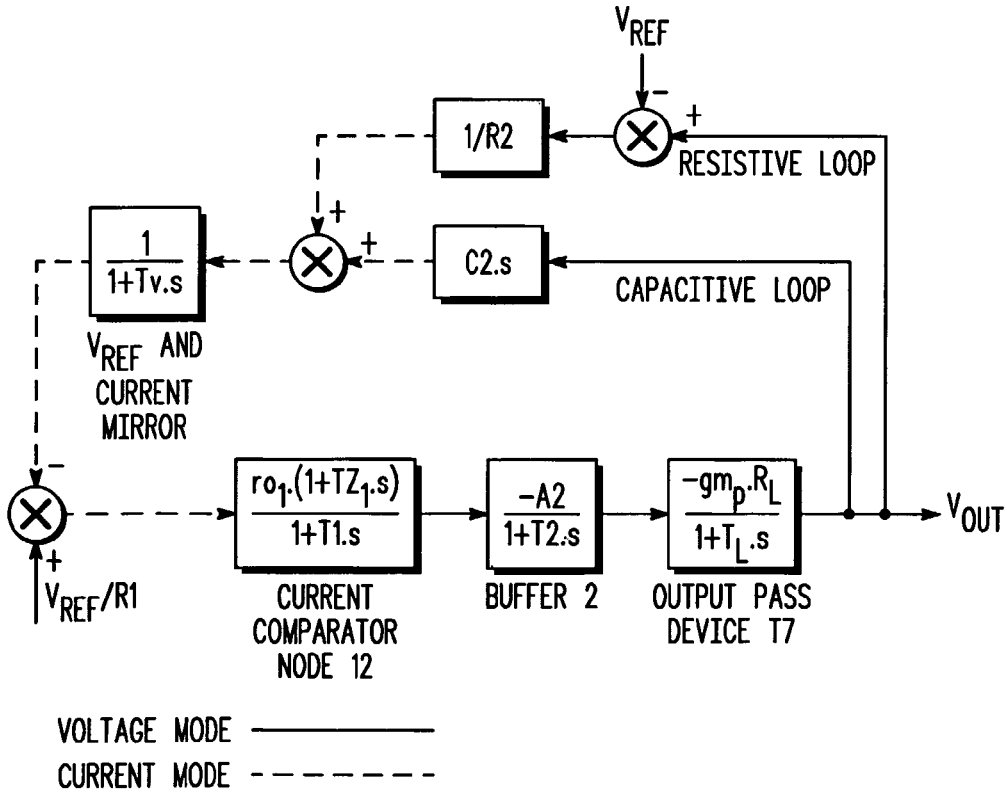
FIG. 6 is a stability analysis equivalent block diagram of the regulator of FIG. 5.

FIG. 6 shows an equivalent block diagram for the purposes of stability analysis of the regulator of FIG. 5. The symbols used in FIG. 6 have the following meanings:

ro1=equivalent resistance at the connection point 12, forming a high impedance node $Gm_p$=transconductance of the T7Pass Device RL=resistance of the load 3

R2=resistance of the resistor 5

C2=capacitance of the capacitor 6

A2=gain of the inverting buffer 2

Tv⇒time constant of the pole formed by the current mirror pair 9 and 10 driven by the amplifier 8

T1=ro1.C1⇒time constant of the pole formed by the capacitor 13 with the equivalent resistance ro1 at the connection point 12

Tz1=Rz1.C1⇒time constant of the 'zero' formed by the capacitor 13 with the resistance Rz1 of the transistor 14 at the connection point 12

T2⇒time constant of the pole formed by the inverting buffer 2

TL=RL.CL⇒time constant of the output pole including the load and the bypass capacitor CL $H_T(s)$=overall transfer function of the regulator observed by exciting the open-circuit resistive feedback path with the capacitive feedback path through the capacitor 6 active.

$H_R(s)$=transfer function of the regulator observed by exciting the open-circuit resistive feedback path with the capacitive feedback path through the capacitor 6 open circuit $H_C(s)$=transfer function of the regulator observed by exciting the open-circuit capacitive feedback path with the resistive feedback path through the resistor 6 open circuit.

The overall transfer function is given by $$H_T(s) = \frac{H_R(s)}{(1 + H_c(s))} \quad \text{Equation 3}$$

where $$H_R(s) = \frac{-\frac{ro_1}{R2} \cdot A2 \cdot gm_p \cdot RL \cdot (1 + T_{Z1}.s)}{(1 + T1.s) \cdot (1 + T2.s) \cdot (1 + T_L.s) \cdot (1 + T_V.s)} \quad \text{Equation 4}$$

and $$H_C(s) = \frac{A2 \cdot gm_p \cdot RL \cdot ro_1 \cdot C2 \cdot s \cdot (1 + T_{Z1}.s)}{(1 + T1.s) \cdot (1 + T2.s) \cdot (1 + T_L.s) \cdot (1 + T_V.s)} \quad \text{Equation 5}$$

s being the Laplace constant (jω=j.2πf).

At steady state, where s is substantially zero:

$$H_C(s) = 0 \quad \text{Equation 6}$$

and $$H_T(s) = H_R(s) = -\frac{ro_1}{R2} \cdot A2 \cdot gm_p \cdot RL \quad \text{Equation 7}$$

At low frequencies, that is to say slow changes in the signals, the values of T1.s, T2.s, $T_L$.s, $T_V$.s, and $T_{Z1}$.s are all much smaller than 1 and Equation 3 reduces to:

$$H_T(s) = \frac{-\frac{ro_1}{R2} \cdot A2 \cdot gm_p \cdot RL}{(1 + A2 \cdot gm_p \cdot RL \cdot ro_1 \cdot C2 \cdot s)} \quad \text{Equation 8}$$

The dominant pole is formed by the time constant A2.$gm_p$.RL.ro1.C2. As soon as the factor A2.$gm_p$.RL.ro1.C2.s is much greater than 1, $H_T(s)$ tends towards $$H_T(s) = -\frac{1}{R2 \cdot C2 \cdot s} \quad \text{Equation 9}$$

Figure 7:
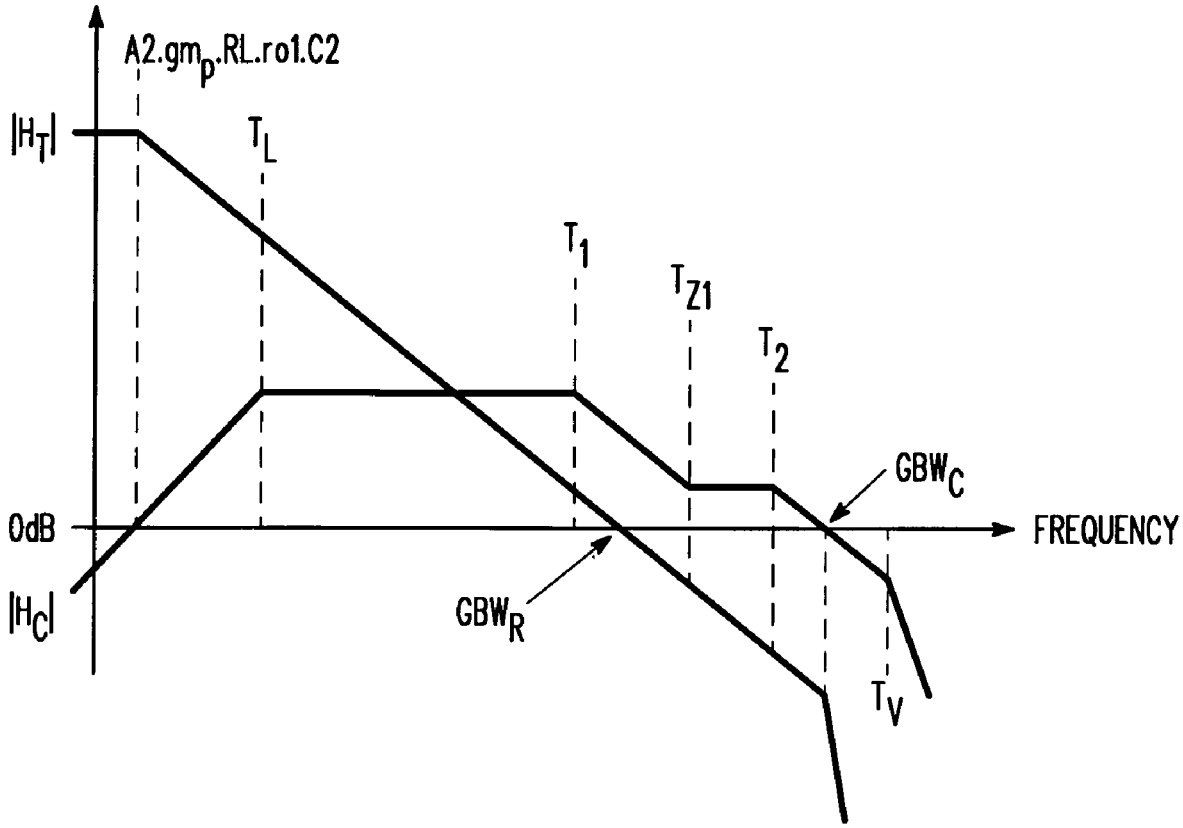
FIG. 7 is a modelised graph of transfer functions of the feedback loop of the regulator of FIG. 5 as a function of frequency.

For frequencies below $GBW_C$, where the transfer function of the capacitive feedback path falls to 0 dB, there is approximate cancellation between the poles of $H_R(s)$ and the poles of $H_C(s)$, producing a linear decline of $H_T(s)$ in a 1st order approximation. The frequency ranges where the $2^{nd}$ and higher order influence of the poles Tv, T1, Tz1, T2, TL and Tz1 appears are indicated in FIG. 7 for one example of implementation of this embodiment of the invention.

It is found that the capacitance of the bypass capacitor CL can be reduced very significantly compared to the regulators. of FIGS. 1 and 3 and, in one example of implementation of an embodiment of the invention, the regulator is found to remain stable with a capacitance CL of 100 nF/100 mA.

Since the feedback current flows in the resistive feedback path and in the capacitive feedback path in parallel, and the capacitive feedback path forms a very low frequency dominant internal pole, all the sub-dominant poles of the regulator tend to be cancelled. It will be appreciated that this reduces the effect of complex poles, or even eliminates them in practice, increasing design robustness concerning regulation stability.

These factors simplify analysis and design of the regulator as overall constraints can be partitioned at sub-block level, reducing design cycle time.

The invention claimed is:

1. A low drop-out DC voltage regulator for regulating a voltage from a DC power supply applied to a load at an output of the regulator and comprising:

a pass device for controlling flow of current from said power supply to said load so as to control the output voltage at said regulator output; and a feedback loop for controlling said pass device, said feedback loop comprising:

a resistive feedback path and a capacitive feedback path that includes a feedback capacitive element in series; and comparator means responsive to signals from said feedback paths for applying to said pass device an error signal that is a function of the value of said output voltage relative to a nominal value so as to control said output voltage, characterised in that said comparator means comprises feedback current producing means by maintaining a common point of said resistive feedback path and said capacitive feedback path at a reference voltage so as to produce a feedback current flowing in said resistive feedback path and in said capacitive feedback path in parallel between said regulator output and said common point, and current comparison means responsive to relative values of said feedback current and of a reference current for producing said error signal.

2. A low drop-out DC voltage regulator as claimed in claim 1, wherein said feedback capacitive element in series in said capacitive feedback path forms a dominant pole in said feedback loop.

3. A low drop-out DC voltage regulator as claimed in claim 1, wherein said resistive feedback path includes a feedback resistive element in series.

4. A low drop-out DC voltage regulator as claimed in claim 1, wherein said feedback current producing means comprises:

current mirror means including a first current conducting element presenting a first conductive path to said feedback current from said common point and a second current conducting element presenting a second conductive path for conducting a current that is substantially equal to said feedback current in said first conductive path; and a voltage amplifier whose output voltage is responsive to a difference in voltage between said reference voltage and said common point for controlling said feedback current flowing in said first current conducting element to maintain said common point at said reference voltage.

5. A low drop-out DC voltage regulator as claimed in claim 4, wherein said current comparison means includes a source of said reference current connected in series with said second conductive path, said comparator means including control means responsive to a voltage at a connection point between said second conductive path and said current source for controlling a voltage applied to control said pass device.

6. A low drop-out DC voltage regulator as claimed in claim 1, wherein said reference current is a function of said reference voltage.

7. A low drop-out DC voltage regulator for regulating a voltage from a DC power supply applied to a load at an output of the regulator and comprising:

a pass device for controlling flow of current from said power supply to said load so as to control the output voltage at said regulator output; and a feedback loop for controlling said pass device, said feedback loop comprising:

a resistive feedback path and a capacitive feedback path that includes a feedback capacitive element in series; and a comparator circuit responsive to signals from said feedback paths for applying to said pass device an error signal that is a function of the value of said output voltage relative to a nominal value so as to control said output voltage, characterised in that said comparator circuit comprises a feedback current circuit producing by maintaining a common point of said resistive feedback path and said capacitive feedback path at a reference voltage so as to produce a feedback current flowing in said resistive feedback path and in said capacitive feedback path in parallel between said regulator output and said common point, and current comparison circuit responsive to relative values of said feedback current and of a reference current for producing said error signal.

8. A low drop-out DC voltage regulator as claimed in claim 7, wherein said feedback capacitive element in series in said capacitive feedback path forms a dominant pole in said feedback loop.

9. A low drop-out DC voltage regulator as claimed in claim 7, wherein said resistive feedback path includes a feedback resistive element in series.

10. A low drop-out DC voltage regulator as claimed in claim 7, wherein said feedback current producing circuit comprises:

a current mirror including a first current conducting element presenting a first conductive path to said feedback current from said common point and a second current conducting element presenting a second conductive path for conducting a current that is substantially equal to said feedback current in said first conductive path; and a voltage amplifier whose output voltage is responsive to a difference in voltage between said reference voltage and said common point for controlling said feedback current flowing in said first current conducting element to maintain said common point at said reference voltage.

11. A low drop-out DC voltage regulator as claimed in claim 10, wherein said current comparison circuit includes a source of said reference current connected in series with said second conductive path, said comparator circuit including a control circuit responsive to a voltage at a connection point between said second conductive path and said current source for controlling a voltage applied to control said pass device.

12. A low drop-out DC voltage regulator as claimed in claim 7, wherein said reference current is a function of said reference voltage.

* * * * *